US008855355B2

(12) United States Patent
Jiang et al.

(10) Patent No.: US 8,855,355 B2
(45) Date of Patent: Oct. 7, 2014

(54) MICRO-SPEAKER

(71) Applicants: Wentao Jiang, Shenzhen (CN); Lei Shi, Shenzhen (CN)

(72) Inventors: Wentao Jiang, Shenzhen (CN); Lei Shi, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 19 days.

(21) Appl. No.: 13/748,003

(22) Filed: Jan. 23, 2013

(65) Prior Publication Data

US 2013/0322679 A1 Dec. 5, 2013

(30) Foreign Application Priority Data

Jun. 5, 2012 (CN) ..... 2012 2 0262324 U

(51) Int. Cl.
*H04R 25/00* (2006.01)

(52) U.S. Cl.
USPC ..... 381/396; 381/388; 381/386; 381/333

(58) Field of Classification Search
USPC ..... 381/333–335, 162, 386, 388–389, 394, 381/396
See application file for complete search history.

(56) References Cited

U.S. PATENT DOCUMENTS 8,081,790 B2 * 12/2011 Lin ..... 381/386
8,189,848 B2 * 5/2012 Lim ..... 381/386

* cited by examiner

*Primary Examiner* — Suhan Ni
(74) *Attorney, Agent, or Firm* — Anova Law Group, PLLC

(57) ABSTRACT

Disclosed is a micro-speaker. A micro-speaker includes a frame forming a receiving space, a vibrating unit, a magnetic circuit unit, a number of contacts, a front cover and a back cover. The contacts include a first contact and a second contact retained by the frame and partially exposed out of the frame, and a third contact disposed within the receiving space. The vibrating unit includes a diaphragm and a voice coil with a first terminal and a second terminal. The first terminal is electrically connected to the first contact, the second terminal is electrically connected to the third contact. An FPC is provided to electrically connect the third contact to the second contact.

7 Claims, 5 Drawing Sheets

MICRO-SPEAKER

FIELD OF THE INVENTION

The present disclosure relates to the art of speakers, particularly to a micro-speaker used in an electronic device.

DESCRIPTION OF RELATED ART

A related speaker includes a frame, a vibrating unit and a magnetic circuit unit accommodating in the frame. The vibrating unit includes a diaphragm and a voice coil driving the diaphragm. The voice coil includes two terminals extending from two ends thereof for transferring electrical signals.

The frame further includes two contacts partially exposed outside for connecting the two terminals to an external circuit. The two contacts are disposed at a same side of the frame, which helps the operators solder the terminals easily. However, considering the two terminals of the voice coil arranged at two sides of the frame, a third contact is provided within the frame for soldering one of the terminals and a conductive wire is used to electrically connect the third contact to one of the contacts.

The magnetic circuit unit assembled in the speaker is usually designed as large as possible for getting a good acoustic performance. However, the inner space of the speaker is limited, so the conductive wire is easy to be pressed and broken up while the diaphragm vibrates or the speaker falls off.

Therefore, it is desirable to provide an improved micro-speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENT

Figure 1:
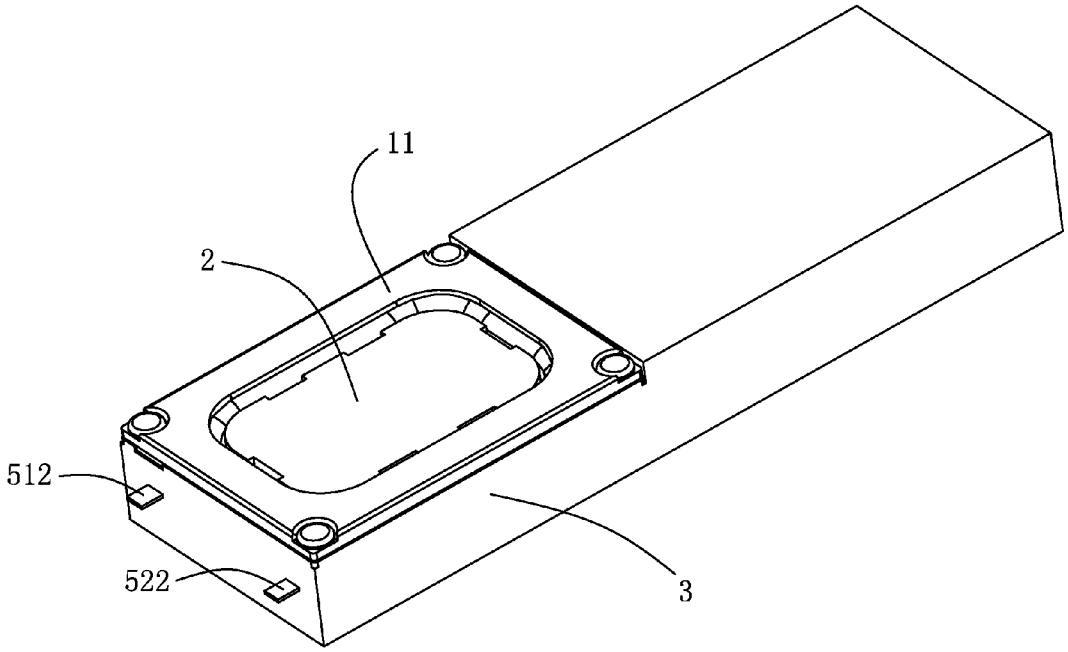
FIG. 1 is an isometric assembled view of a micro-speaker according to an exemplary embodiment of the present disclosure.

Referring to FIGS. 1-4, a micro-speaker 100 includes a frame 3 forming a receiving space, a front cover 11 and a back cover 12 assembled with the frame 3. The micro-speaker 100 further includes a vibrating unit, a magnetic circuit unit 7, a number of contacts and an FPC 8.

Figure 2:
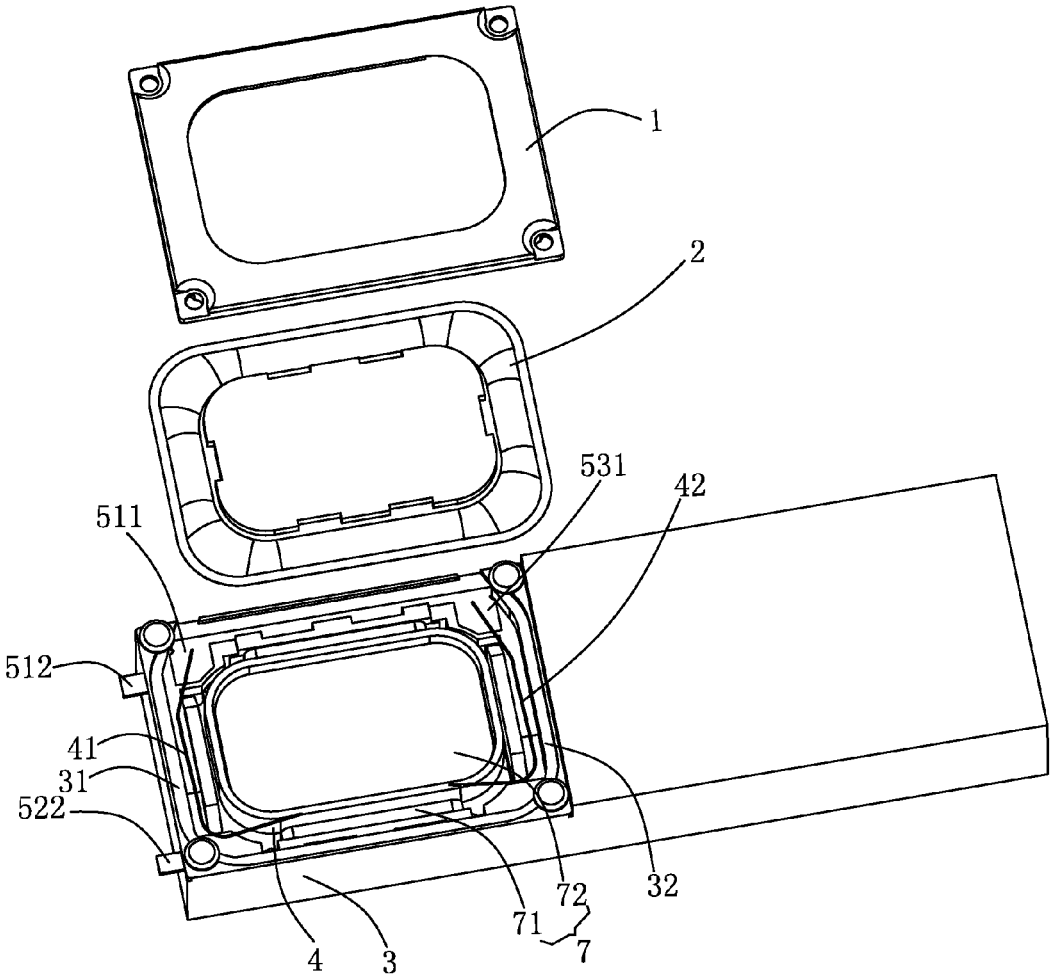
FIG. 2 is an isometric partially assembled view of the micro-speaker shown in FIG. 1, with a front cover and a diaphragm separated.
Figure 3:
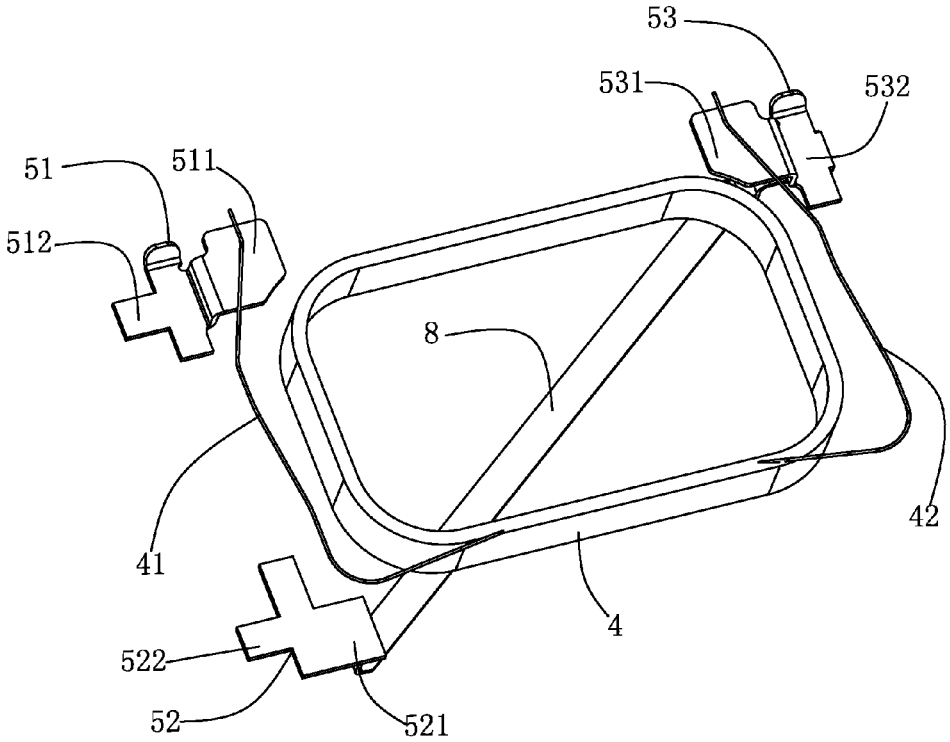
FIG. 3 is an enlarged assembled view of a voice coil, a number of contacts and an FPC of the micro-speaker.

Referring to FIGS. 2-3, the vibrating unit includes a diaphragm 2 and a voice coil 4 driving the diaphragm 2. The voice coil 4 includes a first terminal 41 and a second terminal 42 extending from two ends thereof for transferring electrical signals. The magnetic circuit unit 7 includes a yoke 71, and a magnet 72 disposed in the yoke 71.

The frame 3 includes a first wall 31 and a second wall 32 opposite to the first wall 31. The contacts include a first contact 51 and a second contact 52 disposed at the first wall 31, and a third contact 53 disposed at the second wall 32. The first contact 51 includes a first soldering pad 511 disposed within the receiving space and a connecting portion 512 extending outwards from the first wall 31. The second contact 52 includes a second soldering pad 521 disposed within the receiving space and a second connecting portion 522 extending outwards from the first wall 31. The third contact 53 includes a third soldering pad 531 and a third connecting portion 532 disposed within the receiving space. The first connecting portion 512 and the second connecting portion 522 are both exposed outside of the frame for electrically connecting to an external circuit.

The first terminal 41 of the voice coil 4 is disposed on the first wall 31 of the frame 3 while the second terminal 42 is disposed on the second wall 32. The first terminal 41 is soldered to an upper surface of the first soldering pad 511. The second terminal 42 of the voice coil 4 is soldered to an upper surface of the third soldering pad 531 of the third contact 53.

Figure 4:
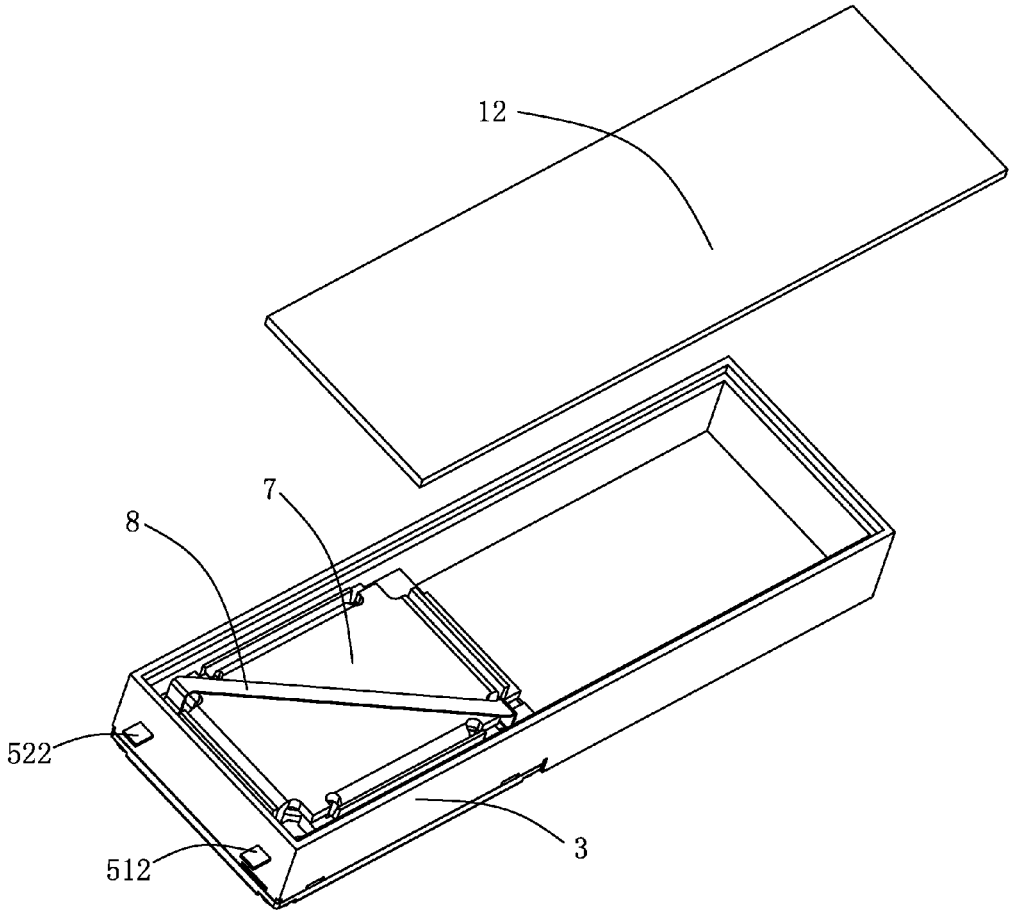
FIG. 4 is an isometric partially assembled view of the micro-speaker in FIG. 1, from another aspect, with a back cover separated.
Figure 5:
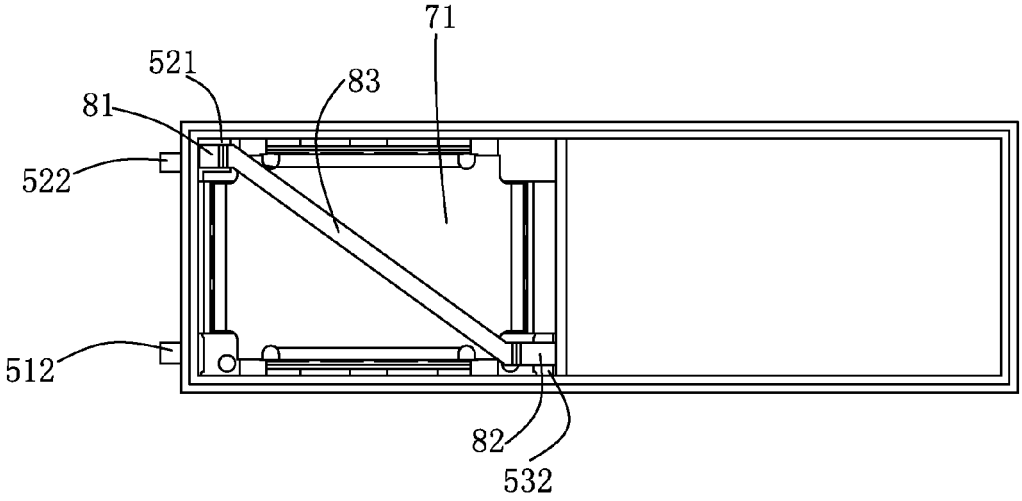
FIG. 5 is a bottom view of the micro-speaker in FIG. 1, with a back cover removed.

Referring to FIGS. 4-5, the FPC 8 is provided to electrically connect the third contact 53 to the second contact 52 and disposed below the magnetic circuit unit 7. The FPC 8 includes a first end 81 attached to a bottom surface of the second soldering pad 521, a second end 82 attached to a bottom surface of the third connecting portion 532 of the third contact 53, and a main portion 83 extending along a diagonal of a bottom surface of the yoke 71. Therefore, the second terminal 42 is electrically linked with the second contact 52 via the FPC 8 crossing the magnetic circuit unit 7. The FPC 8 strides over the magnetic circuit unit 7 without touching the first terminal 41 and the second terminal 42, which provides a more solid and stable electrical connection than using a conductive wire. And the FPC 8 has a small thickness, which makes it possible to design the magnetic circuit unit larger for providing better acoustic performance.

It will be understood that the above-mentioned particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A micro-speaker, comprising:

a frame forming a receiving space and including a first wall and a second wall opposite to the first wall, the first contact, the second contact and the first terminal are all disposed on the first wall;

a vibrating unit attached to the frame, including a diaphragm and a voice coil driving the diaphragm, the voice coil including a first terminal and a second terminal;

a magnetic circuit unit accommodating in the receiving space;

a front cover and a back cover;

a plurality of contacts, including a first contact retained by the frame and partially exposed out of the frame, a second contact retained by the frame and partially exposed out of the frame, and a third contact retained by the second wall of the frame and disposed within the receiving space, the first terminal being electrically connected to the first contact, the second terminal being electrically connected to the third contact;

an FPC provided for electrically connecting the third contact to the second contact; wherein the FPC locates below the magnetic circuit unit and extends along a diagonal of the magnetic circuit unit.

2. The micro-speaker as claimed in claim 1, wherein each one of the first contact and the second contact includes a connecting portion extending outwards from the first wall for connecting to an external circuit.

3. A micro-speaker, comprising:

a frame forming a receiving space;

a vibrating unit attached to the frame, including a diaphragm and a voice coil driving the diaphragm, the voice coil including a first terminal and a second terminal;

a magnetic circuit unit accommodating in the receiving space;

a front cover and a back cover;

a plurality of contacts, including a first contact retained by the frame and partially exposed out of the frame, a second contact retained by the frame and partially exposed out of the frame, and a third contact disposed within the receiving space, the first terminal being electrically connected to the first contact, the second terminal being electrically connected to the third contact a FPC provided for electrically connecting the third contact to the second contact; wherein the magnetic circuit unit includes a yoke, and the FPC strides over the yoke.

4. A micro-speaker, comprising:

a frame forming a receiving space;

a diaphragm;

a voice coil including a first terminal disposed at a first end of the frame and a second terminal disposed at a second end of the frame;

a magnetic circuit unit accommodated in the receiving space;

a first contact and a second contact disposed at the first end of the frame, the first contact electrically connected to the first terminal;

a third contact disposed at the second end of the frame and electrically connected to the second terminal;

a FPC further provided for electrically connecting the third contact to the second contact; wherein the first contact includes a first soldering pad disposed within the receiving space and a first connecting portion extending out of the frame, the first terminal electrically connects to an upper surface of the first soldering pad.

5. The micro-speaker as claimed in claim 4, wherein the second contact includes a second soldering pad disposed within the receiving space and a second connecting portion extending out of the frame.

6. The micro-speaker as claimed in claim 5, wherein the third contact includes a third soldering pad and a third connecting portion within the receiving space, the second terminal is electrically connected to an upper surface of the third soldering pad.

7. The micro-speaker as claimed in claim 6, wherein the FPC includes a first end connected to a bottom surface of the second soldering pad, a second end connected to a bottom surface of the third connecting portion, and a main portion extends along a diagonal of a bottom surface of the magnetic circuit unit.

* * * * *